United States Patent [19]

Parsons

[11] Patent Number: 4,949,128

[45] Date of Patent: Aug. 14, 1990

[54] IMAGE FORMING APPARATUS WITH INTERLEAVED OUTPUT SHEETS

[75] Inventor: Michael H. Parsons, Rochester, N.Y.

[73] Assignee: Eastman Kodak Company, Rochester, N.Y.

[21] Appl. No.: 430,408

[22] Filed: Nov. 2, 1989

[51] Int. Cl.[5] ..... G03G 15/14; G03G 15/01; G03G 21/00

[52] U.S. Cl. ..... 355/271; 355/325; 355/272; 355/326; 355/313

[58] Field of Search ..... 355/325, 313, 311, 273, 355/272, 271, 326

[56] References Cited

U.S. PATENT DOCUMENTS

| | | | |
|---|---|---|---|
| 3,838,919 | 10/1974 | Takahashi | 355/271 X |
| 4,021,109 | 5/1977 | Tanaka et al. | 355/272 X |
| 4,074,934 | 2/1978 | Satomi | 355/272 X |
| 4,201,464 | 5/1980 | Botte et al. | 355/313 X |
| 4,477,176 | 10/1984 | Russel | 355/319 X |
| 4,609,282 | 9/1986 | Crandall | 355/325 |
| 4,681,428 | 7/1987 | Devoy | 355/3 SH |
| 4,690,539 | 9/1987 | Radulski et al. | 355/326 |
| 4,712,906 | 12/1987 | Bothner et al. | 355/3 TR |
| 4,763,161 | 8/1988 | Forest et al. | 355/325 X |

*Primary Examiner*—Fred L. Braun
*Assistant Examiner*—Nestor R. Ramirez
*Attorney, Agent, or Firm*—J. R. Hanway

[57] ABSTRACT

Apparatus and methods for increasing the throughput speed in copiers and printers which produce color transparency output sheets separated by special or slip sheets. A frame transfer sequence is used wherein separate component color images for different output sheets are intermixed on different areas of the transfer member at the same time. After one area contains all of the component images, the composite image is removed and the corresponding frame is skipped while the interleaving sheet is fed through the transfer station of the apparatus. The sequence is repeated until the desired number of output copies are obtained. The invention is applicable to both intermediate and direct transfer reproducing apparatus.

20 Claims, 6 Drawing Sheets

FIG. 11
FIG. 12
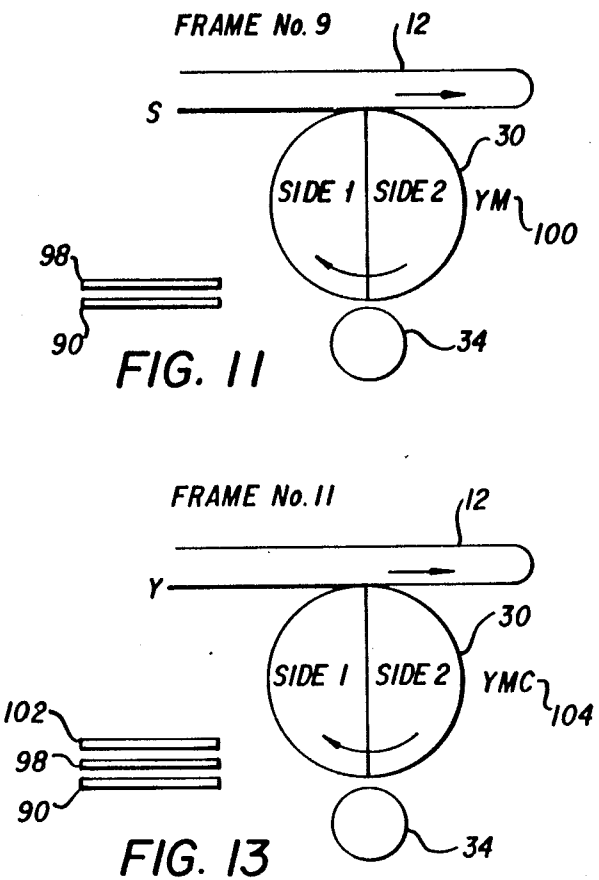
FIG. 13
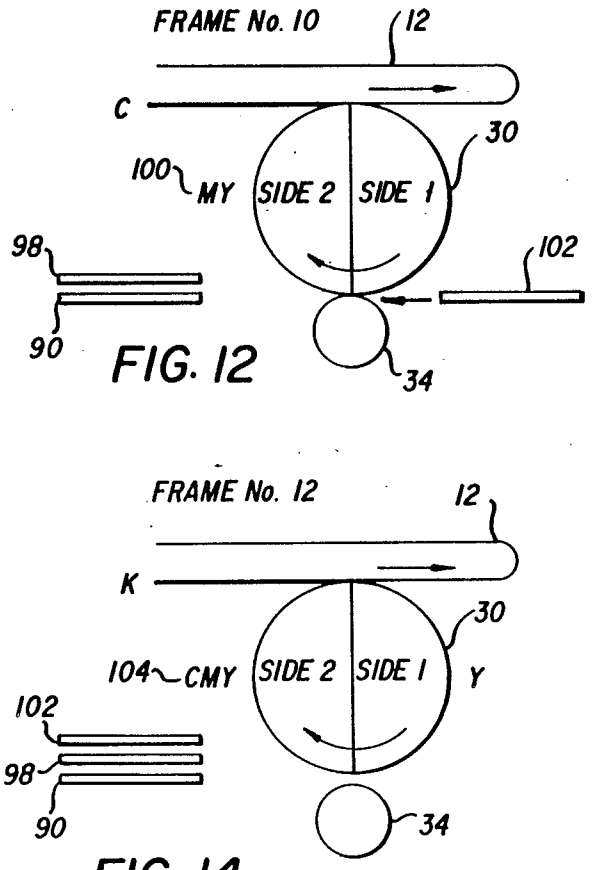
FIG. 14

| FRAME NO. | ACTION TYPE | IMAGES PRESENT SIDE 1 | SIDE 2 | SLIP SHEET FEEDS | TRANSPARENCY FEEDS |
|---|---|---|---|---|---|
| 1 | Y-1 | Y | 0 | | |
| 2 | S-2 | Y | 0 | | |
| 3 | M-1 | YM | 0 | | |
| 4 | S-2 | YM | 0 | | |
| 5 | C-1 | YMC | 0 | SS-2 | |
| 6 | Y-2 | YMC | Y | | |
| 7 | B-1 | YMCK | Y | | |
| 8 | M-2 | 0 | YM | | T-1 |
| 9 | S-1 | 0 | YM | | |
| 10 | C-2 | 0 | YMC | SS-1 | |
| 11 | Y-1 | Y | YMC | | |
| 12 | B-2 | Y | YMCK | | |
| 13 | M-1 | YM | 0 | | T-2 |

FIG. 17

IMAGE FORMING APPARATUS WITH INTERLEAVED OUTPUT SHEETS

BACKGROUND OF THE INVENTION

1. Field of the Invention

This invention relates, in general, to photocopying apparatus and, more specifically, to image transfer sequences used in such apparatus, especially when color transparencies are desired.

2. Description of the Prior Art

Electrostatographic apparatus such as copiers, printers, duplicators, and like devices, can be used to provide hardcopy output sheets containing image information placed on the sheets by the apparatus. In some applications, it is desirable to interleave the output sheets with other sheets for various purposes. Interleaving is especially useful when the output sheets consist of a transparency material.

U.S. Pat. No. 4,681,428, issued on Jul. 21, 1987 with the same assignee as the present invention, describes apparatus for producing interleaved copy sheets. The background section of that patent describes some of the advantages and uses of the interleaved sheets. In general, interleaved sheets reduce the tendency of the sheets of transparency material to stick together and also allows them to slide more freely when a uniform stack is desired. Other uses of interleaved sheets include the ability to produce a copy of what is on the transparency which can be examined or referred to without the need for special projection apparatus and the cleaning action on the fuser to remove contaminants or release agents which might degrade the appearance of the transparency.

The method used to interleave the extra sheets with the output sheets depends upon the type of equipment involved. One type of apparatus presently being used has a "two-up" transfer drum which can handle transfers in quick succession to two output sheets located on the transfer drum substantially at the same time when the sheets are of a specific size. U.S. Pat. No. 4,712,906, which is also assigned to the same assignee as the present invention, discloses electrostatographic apparatus which has a two-up transfer drum. While such apparatus is also useful when making non-color copies, the throughput enhancement provided by the two-up drum is especially important in color copy apparatus where the throughput speed is significantly lowered by the color process.

The apparatus shown in the 4,712,906 patent employs a direct transfer member wherein the output sheets are positioned on the transfer member and receive the developed images directly from the photosensitive member of the machine. Other apparatus known in the prior art uses intermediate transfer drums, rollers, or belts to make the developed image transfer between the photosensitive member and the output sheet. In such apparatus, the developed image is first transferred to the intermediate transfer member and then transferred to the output sheet from the intermediate transfer member. When color copies are to be made, the component color images are all transferred in registration to the intermediate transfer member before the final or composite color image is transferred in one operation to the output sheet.

Whether using direct or indirect transfer apparatus, providing interleaving sheets with two-up transfer devices has the tendency to considerably slow down the throughput rate when color outputs are being produced. According to the prior art, only one of the two image or sheet areas on the two-up transfer member is allocated to the images being reproduced on the regular output sheets. The other area is used to allow integration of the interleaved sheet into the paper flow path of the apparatus. Thus, a throughput rate of only 50% the normal rate can be achieved with interleaved sheets according to such an operational sequence.

Because production speed is important and it increases the efficiency and desirability of the apparatus, it is desirable, and it is an object of this invention, to provide apparatus and methods which allow the interleaving of output sheets with a minimum of degradation of throughput speed.

SUMMARY OF THE INVENTION

There are disclosed herein new and useful apparatus and methods for producing a plurality of regular output sheets containing composite color image information which are interleaved with special or slip sheets. In particular, the invention is especially appropriate for use with apparatus which produces color transparencies which are to be separated by sheets of paper material.

According to the specific embodiment of the invention, a two-up transfer device is used to receive the images contained in frame areas on a moving photosensitive member. When an intermediate transfer device is used as the transfer member, the images are all transferred in registration to the intermediate transfer device and then transferred, as a composite image, to the output transparency sheet. In using the invention with an intermediate transfer device, the first frame transfers yellow image information to a first area or side of the intermediate transfer drum. The second frame transfers a blank, non-image frame, or skip frame, to a second side of the intermediate transfer member. The third frame on the photosensitive member transfers magenta to the first side of the transfer member, thereby creating a composite image of yellow and magenta components thereon. The fourth frame provides another skip or blank transfer to the second side of the transfer member.

Succeeding frames of the sequence provide for the transferring of additional colors to the transfer member, transferring the composite images to the output sheets, and interleaving the output sheets with paper sheets. In frame 5, cyan is transferred to side 1 of the transfer member and, at the same time, a paper slip sheet is fed into the transfer area to receive the non-image information on side 2 of the transfer member. In frame 6, yellow is transferred to side 2 and, in frame 7, black is transferred to side 1. At frame 8, magenta is transferred to side 2 and, since side 1 now has the four-color composite image thereon, a transparency is fed into the transfer area or station to receive the composite image from side 1 of the transfer member. This produces the first transparency from the apparatus.

At frame 9, no image is transferred to side 1, thereby providing a skipped or blank image frame area which, in frame 10, aligns or corresponds to the feeding of a slip sheet through the transfer station to go on top of the previously produced transparency at the output tray of the apparatus. Also in frame 10, cyan is transferred to side 2 of the transfer member. At frame 11, yellow is transferred to side 1 and, at frame 12, black is transferred to side 2 to produce another four-color composite image on side 2 of the transfer member which is transferred to a transparency fed at frame 13. Magenta is also transferred to side 1 at frame 13. The next frame is a repeat of frame 4 where the side 2 is skipped of any transfers, and the next frame accommodates a slip sheet which will be interleaved with the previously produced transparency.

The sequence is repeated, with the exception of the first three frames, for the number of times necessary to produce the desired number of output sheets. By using this sequence and repeating it a sufficient number of times, the throughput rate of the machine is considerably increased over that of the prior art techniques. Instead of requiring a separate blank or non-image frame for each component color image frame which produces one transparency in eight image frames, the present invention reduces the number of non-image frames and produces one transparency for a total of five image frames.

BRIEF DESCRIPTION OF THE DRAWINGS

Further advantages and uses of this invention will become more apparent when considered in view of the following detailed description and drawings, in which:

FIGS. 11, 12, 13 and 14 illustrate the transfer method of this invention during the ninth through twelfth frame transfers;

FIG. 17 is a table summarizing the operation sequence shown in FIGS. 3 through 16.

DESCRIPTION OF THE PREFERRED EMBODIMENTS

Figures 1, 2:
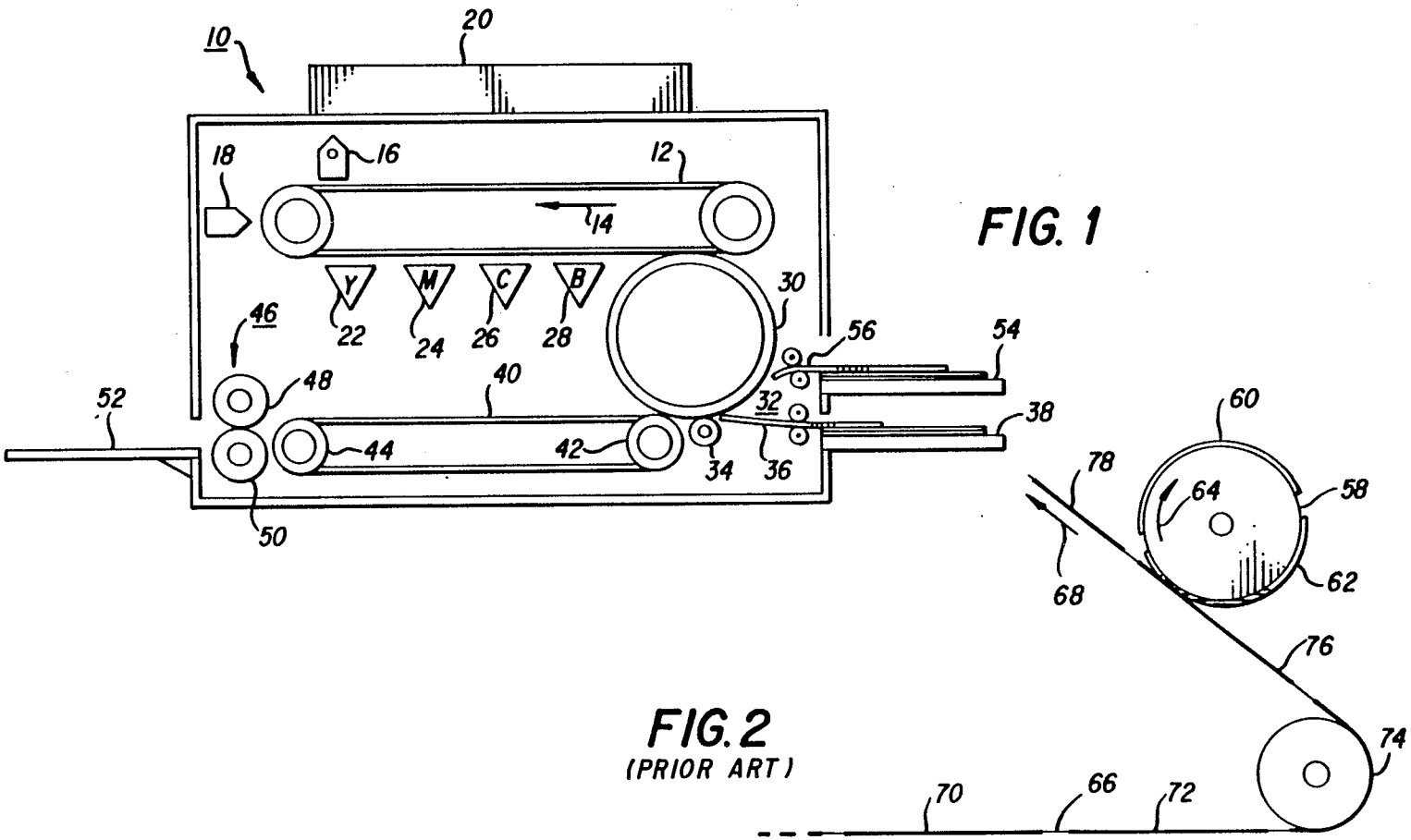
FIG. 2 (PRIOR ART)
FIG. 1 is a diagram showing an intermediate transfer copier wherein the invention may be used.
FIG. 2 is a partial diagram of a direct transfer copier illustrating a prior art technique for producing color transparencies separated by slip sheets.
Figure 4:
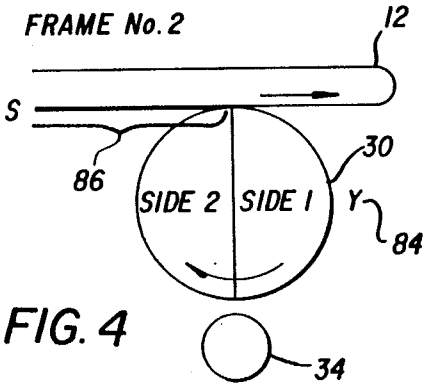
FIGS. 3, 4, 5 and 6 illustrate the transfer method of this invention during the first four frame transfers.
Figure 6:
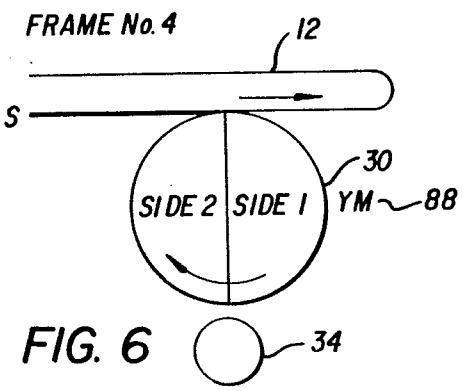

Throughout the following description, similar reference characters refer to similar elements or members in all of the figures of the drawings.

Referring now to the drawings, and to FIG. 1 in particular, there is shown an intermediate transfer copier of the type which may use the invention. The copier 10 includes the photosensitive member or belt 12 which rotates in direction 14. According to conventional operation, the primary charger 16 alters the charge on the member 12 and the printhead 18 selectively exposes portions of the charged belt 12 to create a latent image on the belt corresponding to the original placed upon the platen of the scanner 20. The latent image is developed by the developing stations 22, 24, 26 and 28, depending upon the color to which the particular latent image corresponds. The developed images are transferred to the intermediate transfer drum 30, in registration, to form a composite colored image upon the drum 30. An output sheet 36 of transparency material is taken from tray 38 and placed into transfer station 32 which also includes the transfer roller 34. At this station, the composite image on the drum 30 is transferred to the transparency material.

The conveyor 40, which rotates around the rollers 42 and 44, conveys or transports the sheet 36 to the fuser station 46 where the fusing rollers 48 and 50 fuse the toner to the transparency material and place the finished transparency on the output tray 52. Intermediate or special output sheets are contained on tray 54 and are selectively interleaved with the transparency sheets by the process control of the copier. In other words, there is a sheet 56, which may be of paper material, located between each of the output sheets 36, which consists of a transparency material, when the operation is completed and the required number of copies are placed upon the output tray 52.

FIG. 2 is a partial diagram of a direct transfer copier illustrating a prior art technique for providing color transparencies separated by special or slip sheets. This type of a device is disclosed and illustrated in more detail in U.S. Pat. No. 4,712,906. According to FIG. 2, the two-up transfer drum 58 is sufficiently sized to hold the two sheets 60 and 62 simultaneously, or at the same time. Drum 58 rotates in direction 64 as the photosensitive belt or member 66 moves in direction 68. Image areas or frames 70, 72, 74, 76 and 78, plus additional frames which are not shown on the remainder of the belt, exist for the purpose of containing developed images which can normally be transferred to the copy sheets on the transfer drum 58. In order to separate transparency output sheets with special paper or interleaving sheets at the output of the machine, conventional practice has been to use one of the areas on the two-up transfer drum 58 for the interleaving sheet. In other words, sheet 60 may be the separating paper sheet and sheet 62 on the transfer drum 58 may be the actual output transparency sheet. This means that image frames 70, 74 and 78 are blank or non-image frames which are not used to convey or transfer actual image information to the transparency output sheet 62. The actual desired image information is conveyed by the developed latent images on the belt 66 at positions or frames 72 and 76, as well as other frames not shown in FIG. 2. The net effect of such an arrangement is that the throughput speed of the machine is reduced by approximately 50% from what could be produced if the additional interleaving sheets were not being made, since only half of the image frames are being used to make the actual transparencies.

It is emphasized that the sheet 60 which separates the transparency sheets can take other forms other than a blank or non-image bearing member. In some cases, the same information as transferred to the transparency sheet 62 may be transferred to sheet 60, in which case the frames 70, 74 and 78 would include developed latent images. Another possibility would be to put special image information on the interleaving sheets so that they are neither blank nor contain the same information as put on the regular transparency output sheets. Preprinted or specially colored interleaving sheets can also be used. Regardless of what is on the special or interleaving sheets, which can also be called "slip" sheets, they are special sheets distinct from the regular output sheets of the transparency material. In that respect, the frames on the photosensitive belt which transfer blank or image data to the slip sheets are special frames or areas on the belt separate and distinct from the regular frames used to place the developed images onto the transparency material. It is pointed out that a transfer of a non-image to the slip sheet is equivalent to not making a transfer thereto, for the purposes of describing this invention.

In order to increase the throughput speed of such devices, and to improve their efficiency, this invention describes another technique for sequencing the image frames with the regular output and special interleaving sheets. FIGS. 3 through 16 illustrate the sequence of events or transfers which occur in an intermediate transfer machine according to the present invention to improve the throughput rate. This sequence is started at the beginning of a multicopy output sequence and is repeated through a portion of the frames a number of times in order to produce the desired number of copies. Each sequence is described in relation to what occurs at a particular frame on the photosensitive member of the machine, bearing in mind that it takes four complete frames of developed images to make one composite four-color output. The electronic process control apparatus for the copier (not shown in FIG. 1) provides the means for controlling the frame production, timing, and transfer sequences as taught by this invention.

Figure 3:
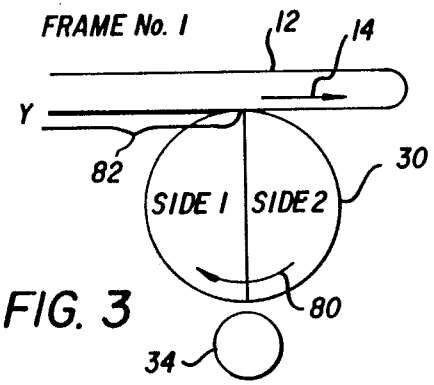

According to FIG. 3, the photosensitive member 12 moves in direction 14 and the intermediate transfer member 30 moves in direction 80. The transfer roller 34 is not engaged with the intermediate transfer member 30 at this time since no transfer to an output sheet is being performed. Frame 1, which would be located in area or region 82 on the belt 12, contains a developed yellow image which is to be transferred to side 1 of the drum 30. Note that the drum 30 has sides 1 and 2 which are allocated to receive image information from different frames on the member 12. Each side represents a specific area on the drum 30 which is dedicated to transfers from specific frame areas on the photosensitive member 12. The sequence next proceeds to frame 2 (FIG. 4) after the drum 30 rotates one-half revolution. Thus, side 1 now contains the yellow developed image 84 and side 2 is ready to receive a blank or skipped image from the frame which is now in area or region 86 of the member 12. As previously indicated, even though a transfer is skipped according to this description, other embodiments of the invention may actually transfer information to side 2 of the transfer drum at this point in time. The invention is simply disclosed and described in this embodiment to produce interleaving or special slip sheets which do not have any information which is transferred to them by the intermediate transfer drum 30.

Figure 5:
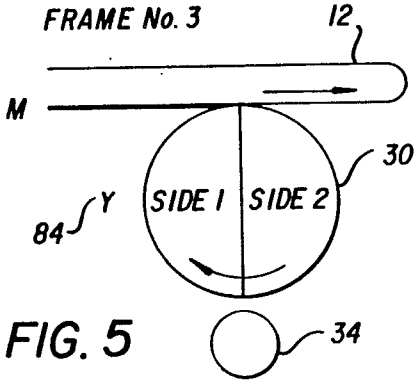
Figure 7:
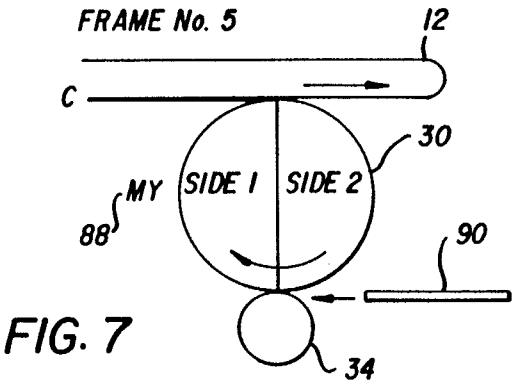
FIGS. 7, 8, 9 and 10 illustrate the transfer method of this invention during the fifth through eighth frame transfers.
Figure 8:
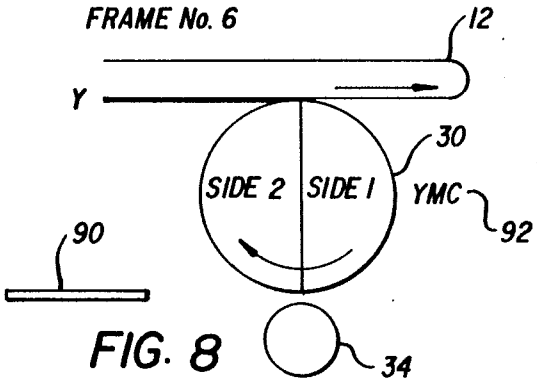
Figure 9:
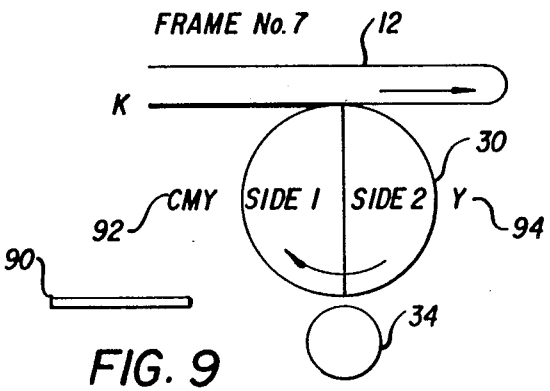
Figure 10:
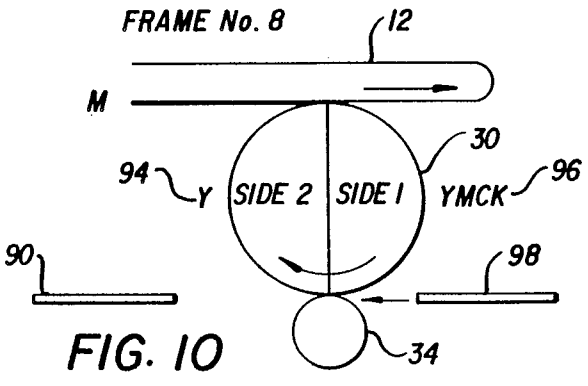

Proceeding to FIG. 5 and frame 3, it can be seen that side 1 still has the yellow image 84 thereon and side 2 does not contain any image information. At this frame, the magenta image is being prepared to be transferred to side 1. According to frame 4 (FIG. 6), the transfer drum 30 has rotated another one-half revolution and the composite image 88 contains the component images of yellow and magenta. At frame 4, another skip in a transfer to side 2 is made so that side 2 still does not contain any image information.

FIGS. 7, 8, 9 and 10 illustrate the operations performed during the next four passages of frames on the photosensitive member 12. At frame 5 (FIG. 7), the cyan image is transferred to side 1 and, at the same time, the slip sheet 90 is fed into the transfer area. Since no images are present on side 2 of the drum 30 at this time, no images are transferred to the slip sheet 90, which may be of paper material. It can be seen that the slip sheet is fed "immediately" at the next frame without any intervening frames. This synchronizes the slip sheet with the skipped frame during the previous cycle of the intermediate transfer member. At frame 6 (FIG. 8), the composite image 92 contains the component images of the yellow, magenta, and cyan colors and the output of the machine contains one slip sheet 90 which was processed or transferred through the transfer area in the previous frame. At frame 6, the yellow component image is transferred to side 2 of the transfer drum 30. In frame 7 (FIG. 9), black (denoted as "K") is transferred to side 1 and the single yellow image 94 exists on side 2 of the transfer drum 30. In frame 8 (FIG. 10), side 1 now contains composite image 96 of the four colors used in the process and the transparency sheet 98 is fed into the transfer area to receive the composite image 96.

FIGS. 11, 12, 13 and 14 illustrate the operations occurring during the next four frames of the sequence. According to frame 9 (FIG. 11), the composite image 100 consists of the yellow and magenta components and side 1 is void of any images thereon because they have just been transferred to the transparency sheet 98 during the previous frame. At frame 9, a skipped transfer takes place so that nothing is transferred to side 1. In frame 10 (FIG. 12), a cyan image is transferred to side 2 and a special or slip sheet 102 is fed into the transfer area synchronously with side 1 in order to pass through the transfer area without receiving any image content from the transfer drum 30. In frame 11 (FIG. 13), a yellow image will be transferred to side 1 and the composite image 104 on side 2 contains the components of yellow, magenta, and cyan. In frame 12 (FIG. 14) of this sequence, black will be transferred to side 2.

Figures 15, 16:
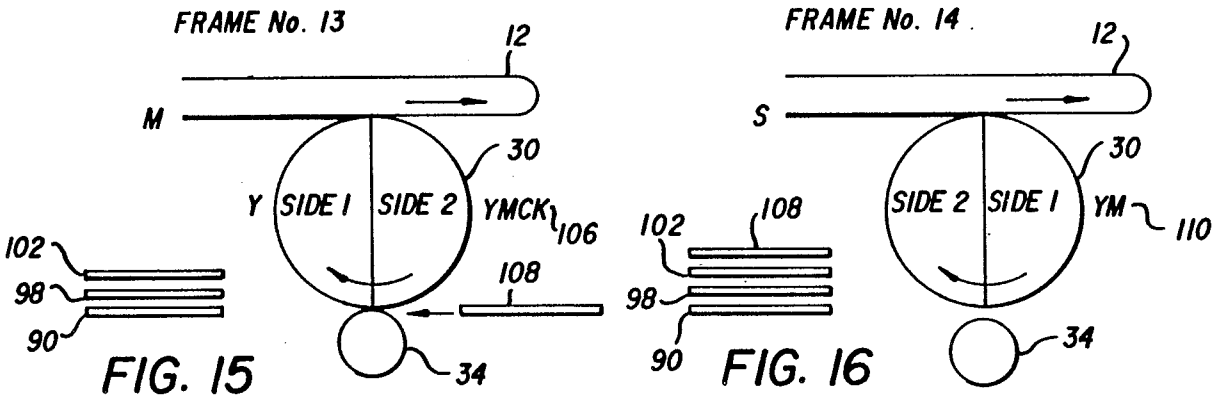
FIGS. 15 and 16 illustrate the transfer method of this invention during the last two frame transfers.

FIGS. 15 and 16 represent the last two frames of the sequence. In frame 13 (FIG. 15), side 2 contains the composite image 106 which includes all four colors in the process and which will be transferred to the transparency sheet 108 which is fed into the transfer area. At the same time, a magenta developed image is transferred to side 1 of the transfer drum 30. Finally, in frame 14 (FIG. 16), side 1 now contains composite image 110 with yellow and magenta components and side 2 does not contain any image information since the four-color composite image was transferred to transparency 108 during the previous frame. At this point in the overall sequence, operation returns to frame 4 where the operation proceeds through frame 14 again to produce another two transparency output sheets interleaved by two slip or special output sheets. The complete operation is repeated a sufficient number of times to produce the desired number of output copies.

FIG. 17 is a table summarizing the operation sequence shown in FIGS. 3 through 16. As can be seen from the table of FIG. 17, the transparency sheets, T-1 and T-2, are fed into the transfer area just after the complete four-color composite images (YMCK) have been formed on each side of the intermediate transfer drum. In a similar fashion, the slip sheets, SS-1 and SS-2, are fed into the transfer area just before any component images are present on the corresponding side of the intermediate transfer drum. It is within the contemplation of the invention that the slip sheets can be interleaved with the transparency sheets at other locations in the apparatus and that passing the slip sheets through the transfer station may not be required. FIG. 17 also shows that, at times during the sequence, the transfer member contains developed images simultaneously for more than one regular output sheet. This intermixing of different images on the transfer member at the same time allows the buildup sequence of the images to be staggered and allows for a systematic interleaving of the slip sheets with the transparency output sheets to improve the throughput and efficiency of the apparatus.

During the repeating sequence of frames (4–13), the blank frames, or those frames not containing normal output data which is to be transferred to the transparencies, are produced immediately after the composite image is transferred to the output transparency. For example, blank or skipped frame S-1 occurs immediately after transparency T-1, and blank frame S-2 occurs immediately after transparency T-2 on a repeat sequence. Also, during the repeated sequences of operation, two types of transfers are made immediately, one after the other, to the two adjacent areas on the drum which can receive image information, whether direct or indirect transfer is involved. For example, frames 5 and 6 transfer, immediately one after the other, cyan to the first area and yellow to the second area of the transfer member. In other portions of the sequence, a special or blank image is transferred immediately after a transfer of a developed image. For example, in frame 8, magenta is transferred to the second area of the transfer member and, in frame 9, a blank or skipped frame, or other special information frame, is immediately transferred to the other adjacent area of the transfer member.

Although described in connection with an intermediate transfer device, the invention disclosed herein is applicable also to apparatus containing a direct transfer member as shown partially in FIG. 2. In such case, the images would be transferred directly to regular output sheets and special interleaving sheets attached to the direct transfer drum. In other words, the transparency on the transfer drum would rotate around more times than the special interleaving sheet and receive all of the composite images. With this type of sequence, as with the intermediate transfer case, two developed images would be transferred immediately, one after the other, to separate sheets on the transfer member during a portion of the repeating portion of the sequence. During another portion of the sequence, a developed image and a special or blank image would be transferred to separate sheets on the transfer member, with the interleaving sheet receiving the special or blank image. After the special interleaving sheet receives its blank or special image information, it is removed and replaced by a regular transparency to start the buildup of the component images thereon.

The transfer sequence disclosed herein increases considerably the throughput rate of the apparatus. According to the prior art, the throughput rate was one transparency print for eight image frames on the photosensitive member, since each of the four color images was interleaved with a blank or special frame image area. With the present invention, one transparency output copy is produced every five image frames. This represents a speed increase of 30% over the sequence used according to the prior art and allows transparencies to be made at 80% the rate of normal color output sheets which do not require interleave sheets therebetween.

It is emphasized that numerous changes may be made in the above-described system without departing from the teachings of the invention. It is intended that all of the matter contained in the foregoing description, or shown in the accompanying drawings, shall be interpreted as illustrative rather than limiting.

I claim as my invention:

1. A method of producing a plurality of regular output sheets containing composite color image information which are interleaved with special sheets on electrostatographic apparatus, said apparatus having an intermediate transfer member sized sufficiently to simultaneously contain separate color images for at least two separate sheets and said apparatus also having means for producing regular developed and special frames for transfer to the intermediate transfer member, said method including the steps of:

intermixing separate color images for different regular output sheets on the intermediate transfer member at the same time;

providing special frames which are aligned for transfer to the intermediate transfer member at predetermined times;

feeding the interleaved special sheets synchronously with the special frames; and transferring the composite images to the regular output sheets after all of the separate color images have been transferred to the intermediate transfer member.

2. The method of claim 1 wherein the regular output sheets consist of a transparency material.

3. The method of claim 1 wherein the special sheets consist of a paper material.

4. The method of claim 1 wherein special frames occur only twice during a complete two-output regular sheet sequence.

5. The method of claim 1 wherein the synchronous feeding of the special sheets feeds a special sheet immediately after a special frame during the next cycle of the intermediate transfer member.

6. The method of claim 1 wherein the blank frames are produced immediately after a transfer of the composite image to the output sheet is made.

7. A method of producing, on electrostatographic apparatus, a plurality of regular output sheets of transparency material containing composite color image information, said sheets being interleaved with other special separating sheets at the output of the apparatus, said apparatus having an intermediate transfer member sized sufficiently to simultaneously contain separate color images for at least first and second regular sheets, said method including the steps of:

building a first composite image on the intermediate transfer member which will be transferred to the first regular sheet;

building a second composite image on the intermediate transfer member which will be transferred to the second regular sheet, with portions of the first and second composite images being present on the intermediate transfer member at the same time;

providing special image areas on the intermediate transfer member at predetermined times;

alternately feeding transparency sheets and separating sheets across the intermediate transfer member such that the first and second composite images are transferred to separate transparency sheets and a special image area is aligned with the separating sheet which is fed between the two transparency sheets.

8. The method of claim 7 wherein the separating sheets consist of a paper material.

9. The method of claim 7 wherein the special image areas are provided only twice during a complete two-output regular sheet sequence.

10. The method of claim 7 wherein the predetermined times are immediately after a regular transparency sheet has been fed.

11. Electrostatographic apparatus for producing a plurality of regular output sheets containing composite color image information which are interleaved with special sheets, said apparatus comprising:

an intermediate transfer member sized sufficiently to simultaneously contain separate color images for at least two separate sheets;

means for producing regular developed and special frames for transfer to the intermediate transfer member;

means for intermixing separate color images for different regular output sheets on the intermediate transfer member at the same time;

means for providing special frames which are aligned for transfer to the intermediate transfer member at predetermined times;

means for feeding the interleaved special sheets synchronously with the special frames; and means for transferring the composite images to the regular output sheets after all of the separate color images have been transferred to the intermediate transfer member.

12. The apparatus of claim 11 wherein the regular output sheets consist of a transparency material.

13. The apparatus of claim 11 wherein the special sheets consist of a paper material.

14. The apparatus of claim 11 wherein special frames occur only twice during a complete two-output regular sheet sequence.

15. The apparatus of claim 11 wherein the synchronous feeding of the special sheets feeds a special sheet immediately after a special frame during the next cycle of the intermediate transfer member.

16. The apparatus of claim 11 wherein the blank frames are produced immediately after a transfer of the composite image to the output sheet is made.

17. A method of producing a plurality of regular output sheets containing composite color image information and a plurality of special interleaved sheets on electrostatographic apparatus which has a direct transfer member sized sufficiently to simultaneously hold at least two complete sheets and which also has means for providing a plurality of developed color images which are transferred to the regular output sheets to form the composite color information, said method including the steps of:

sequentially transferring immediately, one after the other, two developed images to separate output sheets on the transfer member;

sequentially transferring immediately, one after the other, one developed image and one special image to separate sheets on the transfer member;

removing at least the sheet positioned to receive the special image and replacing it with a sheet to receive a developed image, said removed sheet being interleaved between regular color information containing sheets; and repeating at least the above steps a plurality of times until the desired number of sheets are produced.

18. The method of claim 17 wherein the two immediately transferred developed images are in different developer colors.

19. The method of claim 17 wherein the sheet receiving the special image is removed and replaced with a regular sheet which will receive a developed image during the next possible transfer operation to that sheet position.

20. A method of producing a plurality of color transparencies separated by slip sheets on electrostatographic apparatus having a photosensitive member with image frame areas and a two-up intermediate transfer member having first and second transfer areas, said method including the steps of:

forming developed images on the photosensitive member which correspond to the separate color images of yellow (Y), magenta (M), cyan (C), and black (B) which are needed to provide the overall composite color information to be placed on the transparency;

skipping (S) the transfer of any developed images to the intermediate transfer member at predetermined times;

feeding the transparency sheets (T) at predetermined times to receive the composite color information from the intermediate transfer member;

feeding the slip sheets (SS) at predetermined times to go between every transparency sheet;

synchronizing the above steps to provide the following beginning sequence:

| frame no. and type | slip sheet | transparency |
|---|---|---|
| 1 Y-1 | | |
| 2 S-2 | | |
| 3 M-1 | | |
| 4 S-2 | | |
| 5 C-1 | SS-2 | |
| 6 Y-2 | | |
| 7 B-1 | | |
| 8 M-2 | | T-1 |
| 9 S-1 | | |
| 10 C-2 | SS-1 | |
| 11 Y-1 | | |
| 12 B-2 | | |
| 13 M-1 | | T-2 |

where −1 and −2 respectively represent the first and second transfer areas associated with the indicated operation; and repeating the sequence beginning at frame number four until the desired number of transparencies are made.

* * * * *